US012595090B2

(12) United States Patent
Unterlechner et al.

(10) Patent No.: US 12,595,090 B2
(45) Date of Patent: Apr. 7, 2026

(54) EXTRUSION BLOW-MOLDED CONTAINER

(71) Applicant: ALPLA WERKE ALWIN LEHNER GMBH & CO. KG, Hard (AT)

(72) Inventors: Oliver Unterlechner, Bregenz (AT); Florian Heider, Hard (AT); Klemens Bösch, Lustenau (AT); Thomas Bohle, Alberschwende (AT)

(73) Assignee: ALPLA WERKE ALWIN LEHNER GMBH & CO, Hard (AT)

( * ) Notice: Subject to any disclaimer, the term of this patent is extended or adjusted under 35 U.S.C. 154(b) by 75 days.

(21) Appl. No.: 18/262,905

(22) PCT Filed: Jan. 21, 2022

(86) PCT No.: PCT/EP2022/051394
§ 371 (c)(1),
(2) Date: Jul. 25, 2023

(87) PCT Pub. No.: WO2022/161877
PCT Pub. Date: Aug. 4, 2022

(65) Prior Publication Data

US 2024/0076092 A1 Mar. 7, 2024

(30) Foreign Application Priority Data

Jan. 26, 2021 (CH) ..... 00072/21

(51) Int. Cl.
*B65D 1/02* (2006.01)
*B65D 1/00* (2006.01)
(Continued)

(52) U.S. Cl.
CPC ..... *B65D 1/023* (2013.01); *B65D 1/0207* (2013.01); *B65D 41/04* (2013.01); *B65D 2205/02* (2013.01); *B65D 2501/0072* (2013.01)

(58) Field of Classification Search
CPC . B05B 11/0037; B05B 11/0086; B65D 1/023; B65D 1/0207; B65D 41/04; B65D 81/3283; B65D 2205/02; B65D 2501/0072
(Continued)

(56) References Cited

U.S. PATENT DOCUMENTS 2,308,325 A * 1/1943 Binnington ..... B01L 3/508 222/572
3,156,383 A * 11/1964 Melli ..... B65D 51/222 222/215
(Continued)

FOREIGN PATENT DOCUMENTS

DE 1865465 U 1/1963
EP 0674948 A1 * 3/1994 ..... B05B 11/00
(Continued)

*Primary Examiner* — Gideon R Weinerth
(74) *Attorney, Agent, or Firm* — Morriss O'Bryant; Compagni Cannon, PLLC

(57) ABSTRACT

The invention relates to a container produced from a plastic material, in particular by extrusion blow molding, said container comprising a container body having a first end and a second end substantially opposite the first end and having a jacket; a filling opening having a first and second sealing surface formed on the inner wall of the first end, wherein the first and second sealing surfaces can be connected to one another in a fluid-tight manner; and a container base having a standing surface formed at the second end and a pouring opening formed at the first end. The filling opening has a first center axis, and the pouring opening has a second center axis. The first and the second center axis are substantially parallel to one another.

36 Claims, 8 Drawing Sheets

(51) Int. Cl.
*B65D 1/20* (2006.01)
*B65D 41/04* (2006.01)

(58) Field of Classification Search
USPC ..... 215/30, 380; 220/200; 222/572, 480, 222/331, 481; D9/524; 53/476, 477, 53/478, 289, 486; 264/504, 523, 537
See application file for complete search history.

(56) References Cited

U.S. PATENT DOCUMENTS 3,182,861 A * 5/1965 Nataf ..... B29C 49/00 D9/524
3,358,062 A * 12/1967 Lemelson ..... B29C 49/04 264/513
D213,305 S * 2/1969 O'Brien ..... D9/543
3,851,029 A * 11/1974 Cornett ..... B65B 3/022 264/161
D263,930 S * 4/1982 Pardo ..... D9/524
4,572,412 A * 2/1986 Brach ..... B65D 25/465 222/572
4,614,284 A * 9/1986 Miles ..... B05B 11/0037 222/541.2
4,618,076 A * 10/1986 Silvenis ..... B05B 11/1057 222/541.9
4,832,230 A * 5/1989 Janowitz ..... B05B 11/0037 D9/524
D308,166 S * 5/1990 Weckman ..... D9/543
D313,348 S * 1/1991 Ali ..... D9/527
5,337,921 A * 8/1994 Wilson ..... B05B 11/1045 222/105
5,358,148 A * 10/1994 Hanifl ..... B65D 47/141 220/666
D363,215 S * 10/1995 Powell ..... D9/527
5,556,011 A * 9/1996 Jennings ..... B65D 83/06 222/455
5,788,125 A * 8/1998 Steiner ..... B05B 11/0037 222/525
D411,748 S * 6/1999 Klima, Jr. ..... D9/543
5,947,332 A * 9/1999 Klima, Jr. ..... B65D 1/20 222/130
5,964,383 A * 10/1999 Cargile ..... B65D 25/42 222/572
6,213,358 B1 * 4/2001 Libit ..... B05B 11/1032 222/215
6,220,311 B1 * 4/2001 Litto ..... B67D 1/0462 141/98
D451,029 S * 11/2001 Hoffmann ..... D9/524
D456,075 S * 4/2002 Clements ..... D9/557
6,571,977 B2 * 6/2003 Goncalez ..... B65D 1/04 220/633
D548,094 S * 8/2007 Salas ..... D9/563
8,366,023 B1 * 2/2013 Lin ..... B05B 9/0872 239/327
D820,681 S * 6/2018 Howell ..... D9/543
11,427,370 B2 * 8/2022 Goeffers ..... B65D 1/0292
12,195,237 B2 * 1/2025 Unterlechner ..... B65D 25/42
2001/0022204 A1 * 9/2001 Klima, Jr. ..... B05B 11/0056 141/103
2017/0259286 A1 * 9/2017 Thomas ..... G01F 11/262
2024/0076092 A1 * 3/2024 Unterlechner ..... B65D 1/023

FOREIGN PATENT DOCUMENTS

WO 9838094 A2 9/1998
WO 2004035396 A1 4/2004
WO 2017072185 A1 5/2017

* cited by examiner

EXTRUSION BLOW-MOLDED CONTAINER

CROSS-REFERENCE TO RELATED APPLICATIONS

This application is a national phase entry under 37 U.S.C § 371 of PCT/EP2022/051394 filed Jan. 21, 2022, which claims priority to Swiss Patent Application No. 00072/21 filed Jan. 26, 2021, the entirety of each of which is incorporated by this reference.

FIELD OF THE INVENTION

The invention relates to a container produced from a plastic material by extrusion blow molding and to a combination of a container and a screw cap.

PRIOR ART

The production of plastic containers, especially plastic bottles, for example made of polyethylene or polypropylene, takes place in extrusion blow molds. In this case, plastic suitable for blow molding is plasticized and introduced into a tube head by means of an extruder. In the tube head, the plastic is formed into a tube, which is introduced into a blow molding tool. The hose is introduced into the blow molding tool, inflated by overpressure of a gas when the tool is closed so that the hose expands and is pressed against an inner wall of a cavity of the blow molding tool, and assumes the shape of the inner wall, which has a shape that is the negative of a container. The container blown out of the hose is cooled by means of the inner wall until the plastic is hardened. Subsequently, the container is removed from the opened blow molding tool. In a separate step, the so-called slugs, which are formed by the protrusion of the tube during the closing of the blow mold and are generally connected to the removed container, are cut off and can be directed to recycling. The hose can be single-layer or multi-layered.

As a rule, the outlet openings are formed at one end of the container during the blow molding process. Accordingly, during the filling process, the containers are filled via the outlet opening. Thus, the filling speed at the filling line is dependent on the cross section of the outlet opening and the consistency of the product to with which a container is to be filled.

In order to enable an increased filling rate, WO 2017/072185 A1 discloses an extrusion blow molded container that has a first open end and a second end. The first end has a first and a second sealing surface. The sealing surfaces surround a filling opening and can be connected in a fluid-tight manner after filling. The second end is formed as a container base with a standing surface. The fact that the filling opening can extend at most over the entire cross section of the container makes the rapid filling of the container possible.

For pouring the filling material, the container must be cut open or a closure element must be laminated in between the sealing surfaces with a pour opening. If the container is cut open, a pouring opening is produced, which is less user-friendly because an auxiliary means is needed to open it and filling material can easily be spilled during pouring. If a closure element is present, the closure element must be inserted between the sealing surfaces before it can be welded thereto. In addition, the closure element can be produced from a plastic different than that of the container, as a result of which single-type disposal of the container is not possible.

In order to overcome this disadvantage, a filling opening and a separate pouring opening can be provided on an extrusion blow-molded container. It is advantageous if the filling opening is greater than the pouring opening. As a result, the container can be filled quickly and the filling material can be precisely poured out or transferred into another container. In addition, the material requirement is reduced when a screw cap for a small pouring opening is provided. However, such containers cannot be produced easily, since both openings require sufficient space.

Advantages of the Invention

The disadvantages of the described prior art result in an improved extrusion blow-molded container having separate filling and pouring openings. In addition, such containers should be suitable or optimized for easy use in filling plants.

SUMMARY OF THE INVENTION

The posed advantages are achieved in a container produced from a plastic material, in particular by extrusion blow molding, by the features listed in the independent claims. Developments and/or advantageous alternative embodiments form the subject-matter of the dependent claims.

The invention includes a filling opening having a first center axis and the pouring opening having a second center axis, the first and the second center axis are substantially parallel to one another. As a result, the openings can be formed particularly quickly and flexibly during extrusion blow molding.

In one embodiment of the invention, the first and second center axes are oriented parallel to the extrusion direction or to the longitudinal extension of the container. This orientation of the center axes or of the openings saves space, allows a plurality of cavities in molding tools and thus makes it possible to produce a higher number of containers per cycle.

In a further embodiment of the invention, the plane defined by the first and second center axes corresponds to the mold parting plane of the container. This arrangement of the center axes of the openings ensures that sufficient material is present for the formation of threads, in particular external threads.

It proves expedient if the filling opening is defined by a first neck surrounding the filling opening and a first and a second shoulder adjoin the first neck. The first neck can be closed particularly easily by suitable connection techniques, such as welding or adhesive bonding, after the container has been filled through the filling opening. An additional closure or an additional, separately inserted neck is therefore advantageously not required. A first cone is formed by the first and second shoulders. The shoulder angles can be designed flexibly and, as a result, the shoulder geometries can be adapted to various container volumes.

The invention also includes a pouring opening defined by a second neck surrounding the pouring opening and at least one third shoulder adjoins the second neck. As a result, the shoulder geometries of the at least third shoulder can also be adapted to the container shape and the container volume. It is possible that no fourth shoulder adjoins the second neck and the second neck transitions directly into the first shoulder if this is required by the container design.

In a further embodiment of the invention, the third and a fourth shoulder adjoin the second neck. As a result, the third and fourth shoulders also form a separate second cone and the shoulder angles of the third and fourth shoulders are flexibly adaptable to the container design. It must be taken into account that by closing the filling opening, the center axis of the small pouring opening is inclined and that this is influenced by the two shoulder geometries and the intersection thereof. Thus, the design of the third and fourth shoulders can lead to an optimized lateral inclination of the pouring opening, which is a consequence of the substantially circular filling opening becoming a line of half the length of the circumference of the filling opening after the closing. A correspondingly selected inclination can make use by the consumer more comfortable and can improve the complete emptying of the packaging.

It has proven to be advantageous if the pouring opening is provided below the filling opening. As a result, the pouring opening is not in the way during the welding of the filling opening. Nevertheless, it is possible for the second neck to have a particular height, in order to realize design elements, such as a holding strip or a tamper-evident ring, on the screw cap. This embodiment is advantageous in particular when the container according to the invention is used in filling plants.

It has proven advantageous if an external thread, which can interact with the internal thread of a screw cap, is formed on the second neck. The external thread of the pouring opening has been specifically developed for the use of lightweight packagings. It can be formed with very little material. The external thread only obtains its final stiffness through the screw connection with the screw cap, since it is compressed in the manner of an accordion during screwing.

In a further embodiment of the invention, the second and the third shoulder transition into the jacket of the container. As a result, sufficient space is present between the first and the second neck, whereby the respective processing steps are not hindered by one another. For example, the pouring opening can be closed for the first time with a closure tool without the first neck being in the way, or the filling opening can be welded without the second neck being in the way. This is also advantageous in filling plants.

In a further embodiment of the invention, the third shoulder transitions into the first shoulder. This is advantageous if sufficient space remains between the first and the second neck, even though the third shoulder does not directly merge into the jacket of the container or into the container body.

In a further embodiment of the invention, the second neck rises from a platform formed on the container, wherein the platform has a first and a second flank, wherein these flanks taper off into the jacket. The platform increases the torsional stiffness of the pouring opening or of the second neck. This is in particular advantageous during assembly and disassembly of the screw cap.

In a further embodiment of the invention, the shoulder facing the pouring opening has a convex shape. As a result of the first shoulder pulled downward, sufficient space can likewise be created for automatically attaching the screw cap or for connecting the screw cap to a tamper-evident strip or a holding strip.

It proves advantageous if the pouring opening is formed in such a way that it is within the contour of the container base in a plan view of the container. As a result, the requirements for the blow mold are simplified and the second neck can be shaped in a dimensionally accurate manner. In addition, this enables simplified palletizing, because the second neck does not protrude. This is also advantageous if the container is to be decorated, i.e., for example, printed, if labels or the like are to be glued to the container, or if the container is to be wrapped with a shrink film.

In another embodiment of the invention, the first and the second neck are blown together with the container. The provision of the pouring opening and the filling opening therefore does not require any additional production step, but they are blown in the identical mold and at the same time as the container. The production of the container therefore takes place quickly and with no additional production effort. No leakages can occur between the necks and the container body, since both are blown from the identical extruded plastic tube. Clearly visible are extrusion blow molded containers on a seam on the underside of the base that arise when the mold is moved together due to the free end of the plastic hose being pressed together. It proves to be particularly advantageous if the first and second sealing surfaces form a seam with a long side and a first and second seam end when the sealing surfaces are connected in a fluid-tight manner and the first and the second shoulder are formed on the container adjacent to the long side of the seam. After the rapid filling of the container, the container can be reliably closed by a correspondingly dimensioned filling opening.

A ventilation opening is expediently provided on the container. This is expediently arranged opposite the pouring opening and can be a cut-off nipple. As a result, the filling material can flow homogeneously and uniformly out of the container.

In a further embodiment of the invention, the first and second center axes enclose an acute angle c with one another after the filling opening has been closed. As a result, the pouring opening is oriented in the direction of the tilting movement of the container when filling material is poured out. The user friendliness of the container is therefore noticeably improved by forming the angle E.

It proves advantageous if for compensating thermal deformations, at least one compensating groove oriented in the circumferential direction of the shoulders is formed on the shoulders. The compensating groove reduces the deformations or compensates the thermal stresses, which are caused by the welding of the filling opening.

The compensating groove is preferably formed at the transition of the second shoulder to the container body and at the transition of the second neck or the fourth shoulder into the first shoulder 39. At this location, the compensating groove can be formed well and can compensate thermal deformations particularly efficiently.

In a further embodiment of the invention, the at least one compensating groove extends in the direction of the shoulders. As a result, the shoulders are not weakened by the groove. However, it is also conceivable that the groove is circumferential and does not end in front of the shoulders.

The depth of the at least one compensating groove is expediently variable. As a result, the compensating groove can compensate more or fewer deformations at various locations. The shape of the cross section can also have different shapes. The cross section of the groove may be V-shaped.

A further aspect of the invention relates to a combination of a container in accordance with one the above description and a screw cap that can be attached to the second neck. The invention is characterized in that the sealing effect between the sealing element of the screw cap and the second neck is realized in that the second neck is widened when the sealing element projects into the second neck. This type of sealing function makes it possible for the second neck to be designed to be particularly thin-walled, since the necessary stiffness for the production of the seal is provided by the sealing element. As a result, the second neck can be formed with little plastic material.

It proves advantageous if the external thread obtains its final stiffness through the screw connection with the screw cap. In addition to the second neck, the external thread can thereby also be formed in a material-saving manner. The stiffness is achieved by a type of "accordion effect."

In a further embodiment of the invention, the screw cap has a projection to which a tool can be applied and a torque can be transmitted from the tool to the cap. As a result, the screw cap can also be screwed onto the second neck for the first time when there is not sufficient space on the broadside of the container for a standard tool (capper) for attaching the cap to the second neck, and the capper thus cannot grip the screw cap on the outer side thereof. The projection may be a hexagon socket or another form-fitting connection by means of a polygon.

The projection is expediently a depression, which acts as the sealing element. As a result, the sealing element fulfills two functions and the screw cap requires less plastic material for its production in the case of a corresponding design.

It proves to be particularly advantageous if the container is formed in one piece. As a result, not only are further production steps obsolete, but rather single-type disposal of the container together with the pouring element is possible.

A further aspect of the invention relates to a container produced from a plastic material, in particular by extrusion blow molding, according to the preamble of Claim 24. The invention is also characterized in that the filling opening is defined by a first neck surrounding the filling opening and a first and a second shoulder adjoin the first neck, and in that the pouring opening is defined by a second neck surrounding the pouring opening and at least one third shoulder adjoins the second neck. The formation of the first and second necks forms two cones, the opening angles or shoulder angles of which can be designed flexibly.

In one embodiment, the shoulder angles of the first and second necks are defined in that the filling opening has a first center axis and the pouring opening has a second center axis, and in that the first and second center axes define a plane, wherein an imaginary first straight line extending along the first shoulder and lying in this plane encloses an angle $\alpha$ with respect to the first center axis that differs from an angle $\beta$ that is enclosed, with respect to the first center axis, by an imaginary third straight line extending along the third shoulder and lying in this plane. As a result, the two necks can be adapted to basic shapes of the container (bag) of various widths.

It has proven expedient if the third and a fourth shoulder adjoin the second neck, wherein the fourth shoulder transitions into the first shoulder. As a result, the shoulder geometries on the second neck can be designed even more flexibly.

In another embodiment, the shoulder angles of the first and second necks are also defined in that an imaginary, second straight line extends along the second shoulder and lies in the plane defined by the first and second center axes encloses an angle $\gamma$ with respect to the first center axis that differs from an angle $\delta$ that is enclosed, with respect to the first center axis, by an imaginary, fourth straight line extending along the fourth shoulder and lying in this plane.

Given that the first center axis and the second center axis are oriented substantially parallel to an imaginary main axis of the container, space can be saved and a plurality of cavities can be provided in the blow mold. This enables faster cycle times, which is advantageous ecologically and economically.

The following 7 embodiments enable flexible geometries in terms of the shoulders and shoulder angles, whereby the following points can be realized in an advantageous manner.

By adapting the shoulder geometries, various sizes or volumes of the container or of the bag can be realized.

The separation of the height of the pouring opening from the height of the weld seam enables a higher neck design of the second neck, whereby sufficient space is present for design elements, such as a captive screw cap or a tamper-evident ring.

Sufficient space can be created between the filling opening and the pouring opening, in order to facilitate the automatic closing of the pouring opening with a closure tool (capper) and to enable the use of a welding bar for closing the filling opening.

It has proven expedient if the angle $\alpha$ is greater than the angle $\beta$ or that the first and third shoulders together form an at least approximately concave shape.

It has proven expedient if the angle $\alpha$ is less than the angle $\beta$ or that the first and third shoulders together form an at least approximately convex shape.

It has proven expedient if the third and a fourth shoulder adjoin the second neck, wherein the fourth shoulder transitions into the first shoulder.

It has proven expedient if the angle $\beta$ and the angle $\delta$ are approximately equal and are in the range of 10-30 degrees, in particular 18-22 degrees.

It has proven expedient if at least one of the shoulders is curved and the corresponding first, second, third or fourth straight line is a tangent at the apex of the shoulder curvature.

It has proven expedient if the angle $\alpha$ is in the range of 30-60 degrees, in particular 40-50 degrees.

It has proven expedient if the angle $\beta$ and/or the angle $\delta$ is 0 degrees.

In another embodiment, the pouring opening is provided below the filling opening. As a result, the pouring opening is not in the way during the welding of the filling opening. Nevertheless, it is possible for the second neck to have a particular height, in order to realize design elements, such as a holding strip or a tamper-evident ring, on the screw cap. This embodiment is advantageous in particular when the container according to the invention is used in filling plants.

With regard to the plastics material according to the invention, it should especially be observed that this should be weldable or adhesive at least in the region to be sealed. In this context, reference is made to the disclosure of WO 2017/072185 A1.

BRIEF DESCRIPTION OF THE DRAWINGS

Further advantages and features become apparent from the following description of a plurality of exemplary embodiments of the invention with reference to the schematic representations. in a representation not true to scale, are shown.

DETAILED DESCRIPTION OF THE INVENTION

Figure 1A:
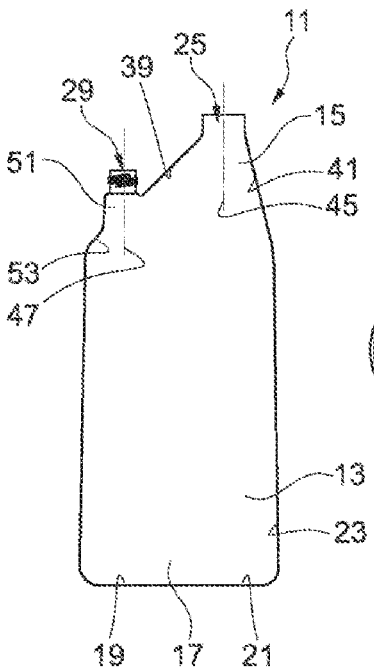
FIGS. 1*a*, 1*b*, 1*c*: a side view, a plan view and a perspective view of an extrusion blow-molded container with a filling opening and a pouring opening.

FIGS. 1 to 5 and 8 to 15 show possible embodiments of a container that is produced from a plastic material by extrusion blow molding and is designated overall by reference sign 11. FIG. 1 shows a front view, a side view and a perspective view of a possible embodiment of the container 11.

The container 11 has a container body 13 that has a first end 15 and a second end 17 that is substantially opposite the first end 15. The second end 17 is closed in a fluid-tight manner and is designed as a container base 19 on which a standing surface 21 is formed. The extrusion blow molded container 11 has an inner wall 23. The inner wall 23 delimits at the first end 15 a filling opening 25 through which a filling material is added into the extrusion blow molded container 11. The first end 15 has on its inner wall 23 a first sealing surface 27*a* and a second sealing surface 27*b* opposite the first sealing surface 27*a*, which can be connected to one another in a fluid-tight manner and are connected to one another in a fluid-tight manner after the filling material has been added. For this purpose, the sealing surfaces 27*a*, 27*b* can be welded. The container 11 may be produced from a weldable plastic. Alternatively, the sealing surfaces 27*a*, 27*b* can be coated with a hot-melt adhesive or an adhesion promoter, which can also be textured. The filling opening 25 has a such a width that the container can be filled quickly with filling material and without overflow into the container 11.

A pouring opening 29 is formed below the sealing surfaces 27*a*, 27*b*. The pouring opening 29 is blow-molded together with the other containers 11 and is therefore simultaneously formed with the container 11 in the blow mold by inflating the container material.

After the filling of the container 11, the sealing surfaces 27*a*, 27*b* are connected to one another in a fluid-tight manner by bringing them into contact with one another and thereby closing the filling opening 25. In the closed state, the sealing surfaces 27*a*, 27*b* form a seam 31, which is shown in FIGS. 3 and 8. The seam 31 has a long side 33 and a first and second seam end 35, 37. As a result of this deformation, a first and a second shoulder 39, 41 are formed below the long side 33 on the container 11. The base 19 can have the shape of an ellipse 43.

The filling opening 25 has a first center axis 45 and the pouring opening 29 has a second center axis 47. It is particularly advantageous if the first and second center axes 45, 47 are parallel to one another and are oriented parallel to the extrusion direction or to the longitudinal extension of the container 11. During the production in the EBM (extrusion blow molding) method, it is particularly favorable if both openings 25, 29 lie in a line parallel to the tube. This saves space, allows a higher number of cavities in a molding tool, thus enables higher output and is therefore economically and ecologically advantageous.

The filling opening 25 is defined by a first neck 49 which surrounds the filling opening 25 and which the first and second shoulders 39, 41 adjoin. The pouring opening 29 is defined by a second neck 51 surrounding the pouring opening 29. At least one third shoulder 53 adjoins the second neck 51.

In a particularly advantageous embodiment, both openings 25, 29 lie within the mold separation. This ensures that sufficient material is present for the formation of an external thread 55 on the second neck 51.

In a further embodiment of the container 11 (FIG. 2), the first neck 49 extends into the first and second shoulders 39, 41, wherein the second shoulder 41 transitions into the container body 13 or into the jacket 14 of the container 11. The second neck 51 extends into the third shoulder 53 and into a fourth shoulder 57 (FIG. 2). The third shoulder 53 can either extend directly into the container body 13 (FIGS. 2, 3*b*, 4*b*) or is offset and extends into the first shoulder 39 (FIGS. 1, 3*a*, 4*a*, 8, 9).

The second neck 51 can also transition directly into the first shoulder 39 if the basic shape of the container 11 (FIGS. 3, 4, 8*a*, 9*a*) allows, whereby a fourth shoulder 57 is omitted. The first and second necks 49, 51 are therefore attached to two separate cones (FIG. 2). The division into four shoulders enables flexible adaptation of the pouring and filling openings 29, 25. As a result, the pouring opening and the filling opening find sufficient space on the broadside of the container 11 in the case of basic shapes of the container 11 of different widths. The up to four shoulders and their different shoulder angles have even further advantages:

By adapting the shoulder geometries, the pouring and filling openings 29, 25 on containers of various sizes or volumes can be provided on the broadside of the container, without space problems occurring. The pouring opening 29 is lower than the filling opening 25. In this way, the filling opening 25 can be welded or glued without the pouring opening 29 being in the way in this processing step. As a result of the adaptation of the shoulders, sufficient space for the closure of the pouring opening 29 and elements, such as a tamper-evident ring 59 or a holding strip, is also available. The different positions of the pouring opening in comparison to the filling opening in the case of different shoulder geometries are shown in FIGS. 3 and 8 and illustrated by the double arrows.

Figure 4A:
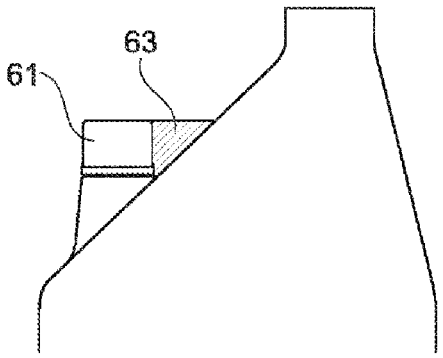
FIGS. 4*a*, 4*b*: the 2nd and 3rd embodiment, in which the space requirement between the two openings is emphasized.
Figure 4B:
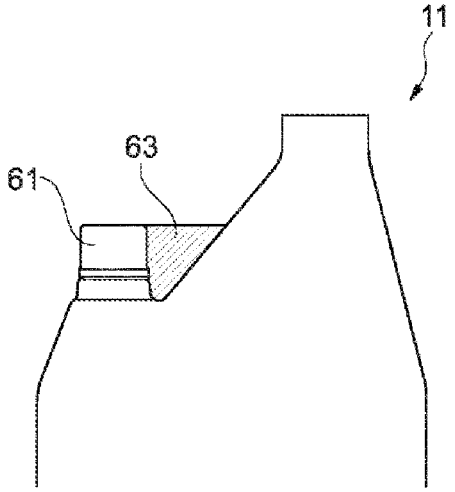
Figure 9A:
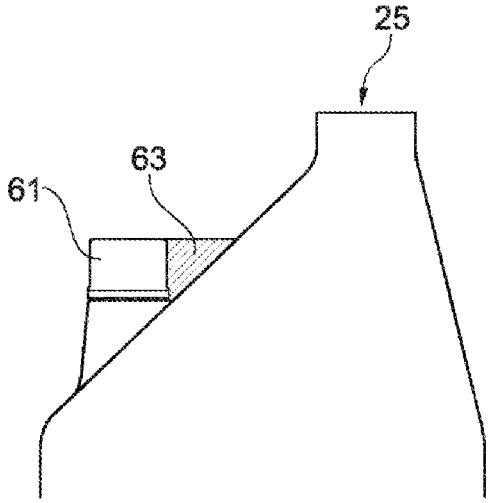
FIGS. 9*a*, 9*b*: a comparison of the embodiment with a straight and a convex shoulder geometry and the associated space requirement.
Figure 9B:
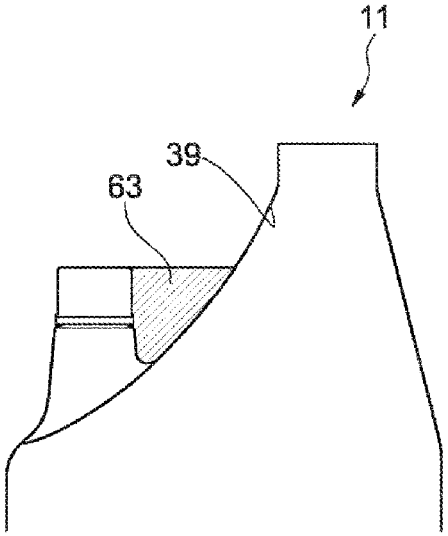

There is also sufficient space between the pouring opening and the filling opening, so that a closure tool can be used in order to be able to attach a screw cap 61 to the second neck 51. The sufficient distance is illustrated in FIGS. 4 and 9 by the hatched area 63. In the comparison of the shoulder geometries shown in FIGS. 4*a* and 9*a* with the shoulder geometries shown in FIGS. 4*b* and 9*b*, it is apparent that the shoulder geometries shown in FIGS. 4*b* and 9*b* enable significant space gains with the same dimensioning of the filling opening and the pouring opening.

Figure 5:
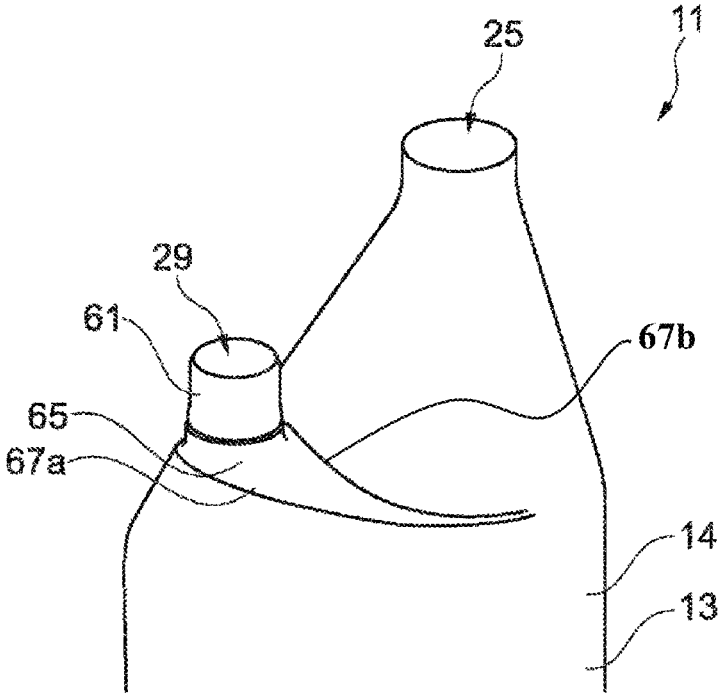
FIG. 5: a perspective view of a 4th embodiment in which a platform is formed on the container.
Figure 6:
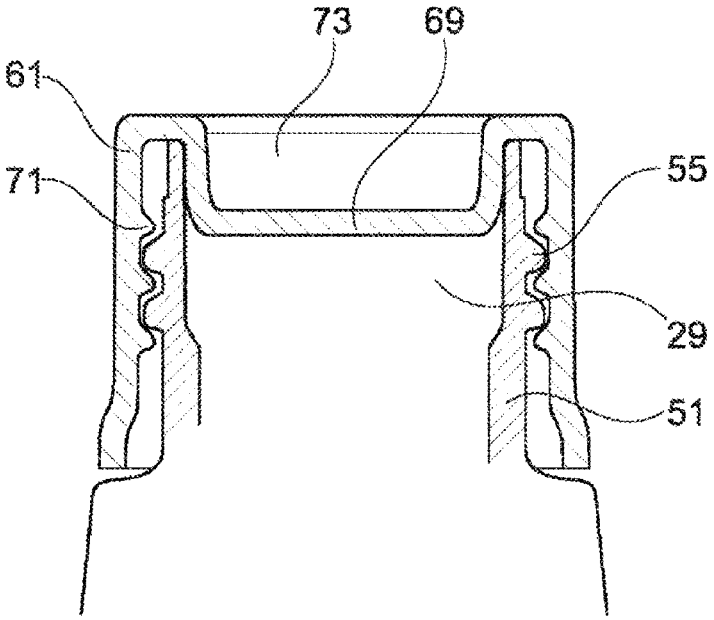
FIG. 6: a sectional view through the pouring opening and a screw cap attached to the pouring opening.
Figure 7:
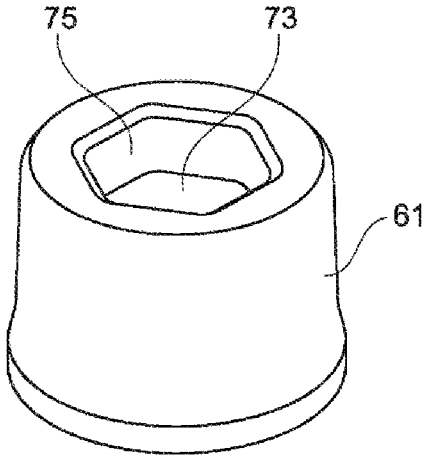
FIG. 7: the screw cap in a perspective view.

FIG. 5 shows the container 11 with a platform 65. The platform 65 has a first and a second flank 67*a*, 67*b*, which taper off into the container body 13 or the jacket 14. The platform 65 increases the torsional stiffness of the pouring opening 29 or of the second neck 51. This is in particular important during the assembly and disassembly of the screw cap 61.

The external thread 55 has been developed specifically for the use of lightweight packagings. It can be formed with very little material and only obtains its final stiffness through the screw connection with the screw cap 61, since it is compressed by the attached screw cap 61.

The screw cap 61 has a sealing element 69, which projects into the pouring opening 29 when the screw cap is attached to the second neck 51. In addition, the screw cap 61 has an internal thread 71, which interacts with the external thread 55. The sealing element is designed to be rigid in such a way that it can widen the thin-walled second neck 51. This results in the sealing effect between the second neck 51 and the screw cap 61.

The screw cap 61 has a depression 73, which acts as the sealing element 69. The depression can have a projection for a tool in order to be able to transmit a torque to the screw cap 61 in a form-fitting manner. The projection can be a hexagon socket 75 or another polygon.

Figure 8A:
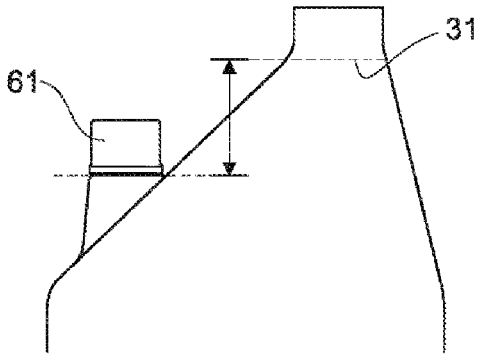
FIGS. 8*a*, 8*b*: a comparison of an embodiment with a straight and a convex shoulder geometry and the different position of the pouring opening in comparison to the filling opening.
Figure 8B:
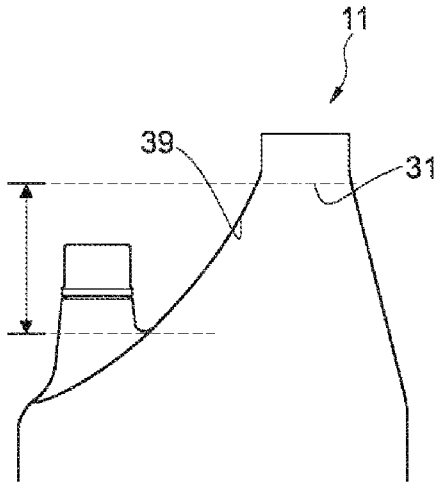

FIGS. 8*b* and 9*b* show a further embodiment in which the first shoulder 39 has a convex shape. The first shoulder 39 is thus bent away from the pouring opening 29. As a result of the convex first shoulder, in addition to providing two cones below the first and second necks 49, 51, sufficient space can be created for the automatic screwing of the screw cap 61, for the closing of the filling opening 25 and a required height can be created for providing a tamper-evident ring and/or a holding strip.

In order to form a homogeneous filling material flow during pouring, a ventilation opening 77 can be provided on the container body 13 (FIG. 2). This can be realized by a nipple that can be cut.

Figure 1B:
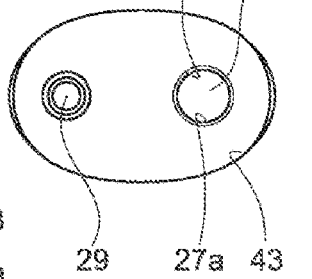
Figure 1C:
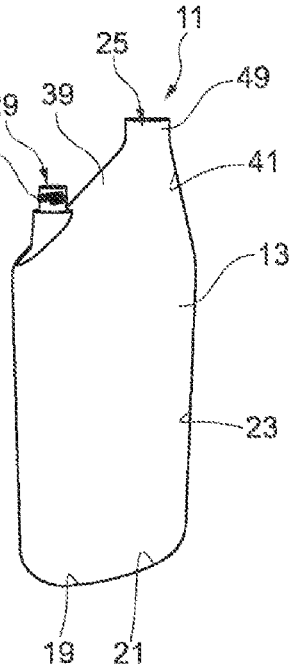
Figure 2:
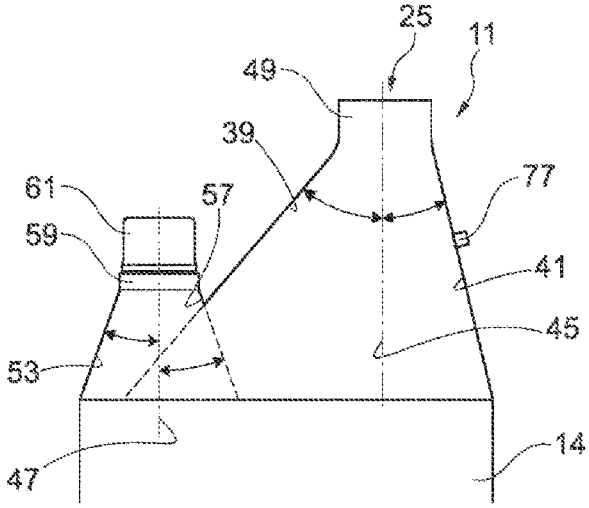
FIG. 2: a 1st embodiment of the container with attached screw cap in a side view.
Figure 3A:
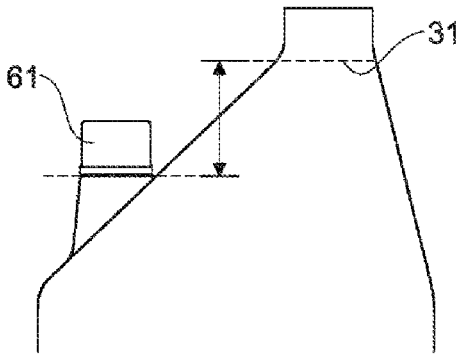
FIGS. 3*a*, 3*b*: a 2nd and a 3rd embodiment of an extrusion blow-molded container with attached screw cap in a side view, which show, among other things, that the pouring opening is arranged below the filling opening.
Figure 3B:
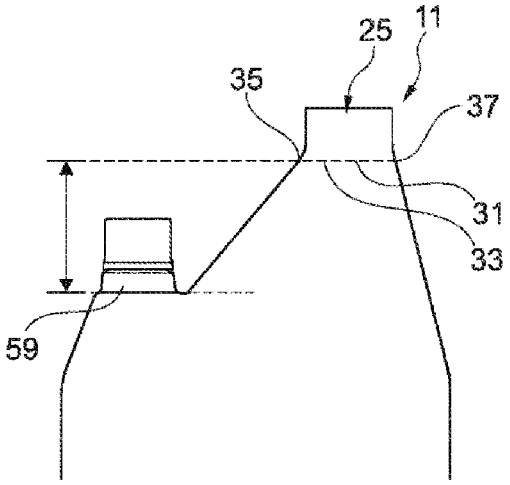

FIG. 1*b* shows that the pouring opening 29 and the filling opening 25 are formed in such a way that they lie within the base 19 or the largest body contour in the plan view of the container 11. The pouring opening and the filling opening therefore lie within the "footprint" of the container 11.

Figure 10:
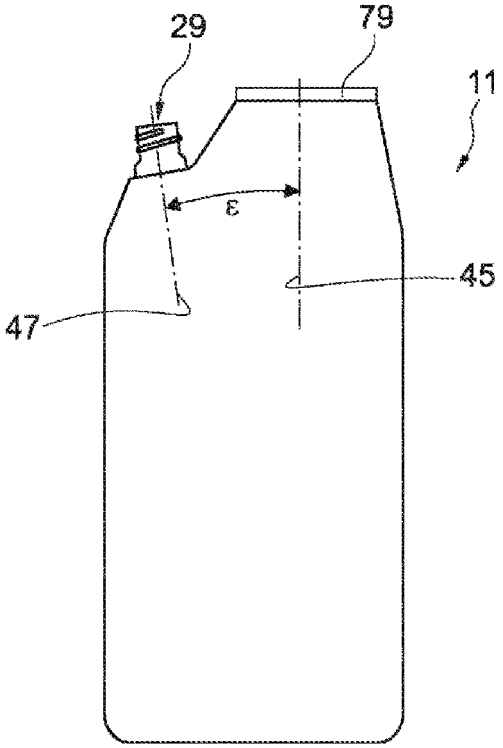
FIG. 10: a side view of the container after the filling opening has been welded.

The shoulder design can lead to an optimized lateral inclination of the pouring opening 29 by changing the shape in the welding process. This change in the inclination of the second center axis 47 by closing the filling opening 25 with a weld seam 79 is shown in FIG. 10 and defined by the angle c, which indicates the angle between the first and second center axes 45, 47 after the closing of the filling opening 25 and is an acute angle. This inclination of the second center axis 47 relative to the first center axis 45 is influenced by the two shoulder geometries and their intersection. Thus, the design of the third and fourth shoulders 53, 57 can lead to an optimized lateral inclination of the pouring opening 29, which is a consequence of the substantially circular filling opening 25 becoming a line of half the length of the circumference of the filling opening 25 after the closing. A correspondingly selected inclination can make use by the consumer more comfortable and can improve the complete emptying of the packaging, since the second center axis 47 is oriented in the tilting direction of the container 11 during pouring.

Figure 11:
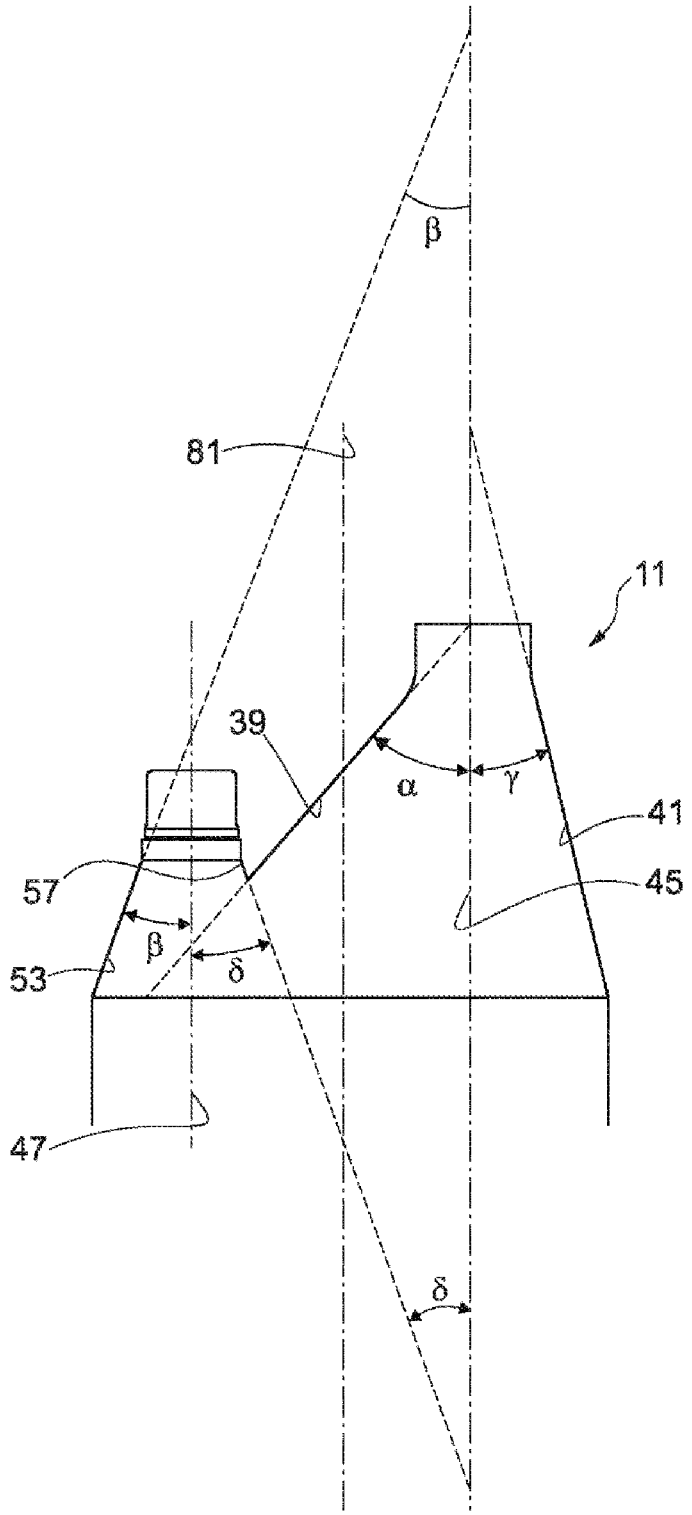
FIG. 11: a side view in which the inclination angles of the shoulders are shown.

FIG. 11 shows the angles between the four shoulders 39, 41, 53, 57 and the first center axis 45. The first and second center axes 45, 47 span a plane. A first, a second, a third and a fourth straight line, which extend along the first, second, third and fourth shoulders, lie in this plane. If one of the shoulders were to be curved, the corresponding straight line would extend as a tangent at the apex of the shoulder curvature. The container 11 has a main axis 81, which is parallel to the first and second center axes 45, 47 and is oriented parallel to the extrusion direction or to the longitudinal extension or to the jacket 14 of the container 11.

The first straight line encloses an angle $\alpha$ with the first center axis 45. The third straight line encloses an angle $\beta$ with the first center axis 45. The second straight line encloses an angle $\gamma$ with the first center axis 45. The fourth straight line encloses an angle $\delta$ with the first center axis 45. Since the first and second center axes 45, 47 are parallel, the four angles also occur between the four straight lines and the second center axis 47.

It is advantageous if the angles $\alpha$ and $\beta$ are different and the angles $\gamma$ and $\delta$ are different. It is advantageous if the angle $\alpha$ is in the range of 30-60 degrees, in particular 40-50 degrees. It is also advantageous if the angle $\beta$ and the angle $\delta$ are approximately equal and are in the range of 10-30 degrees, in particular 18-22 degrees. The angle $\beta$ or the angle $\delta$ may be 0 degrees. If the angle $\beta$ and the angle $\delta$ are 0 degrees, then the second cone becomes a cylinder.

Figure 12:
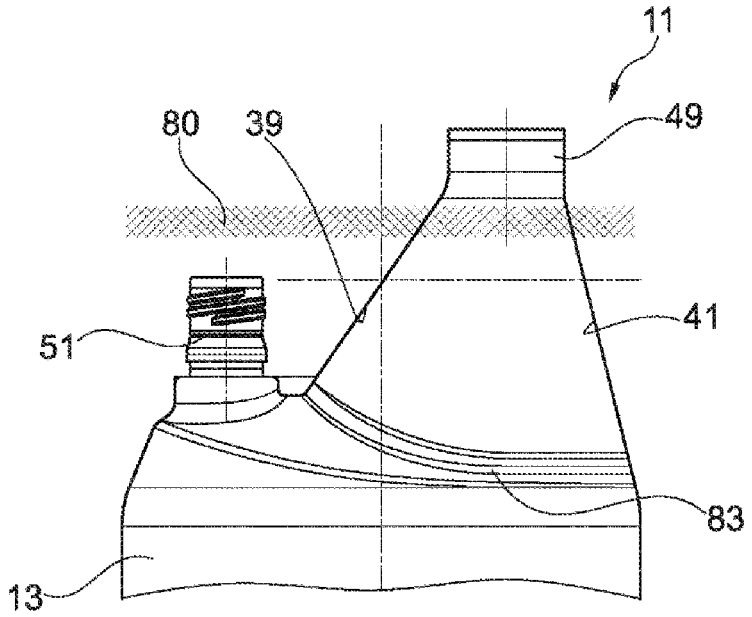
FIG. 12: a side view of the container in an embodiment with two visualized compensating grooves.
Figure 13:
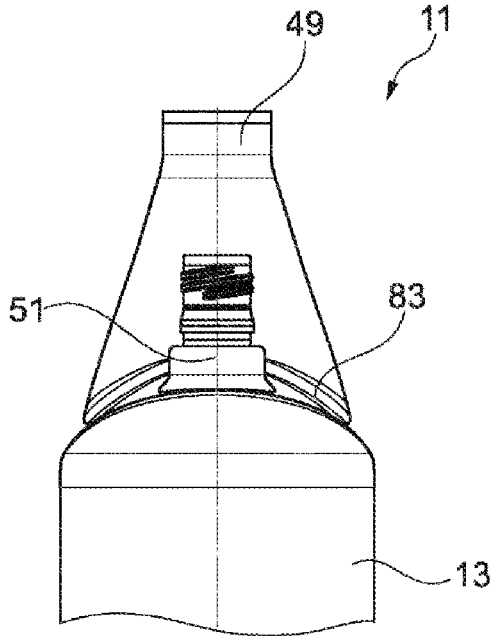
FIG. 13: a further side view of the container of FIG. 12.
Figure 14:
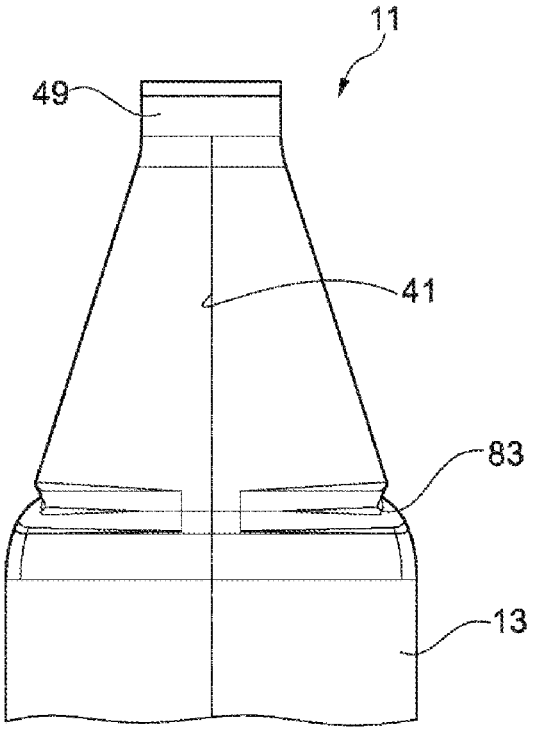
FIG. 14: a further side view of the container of FIG. 12.
Figure 15:
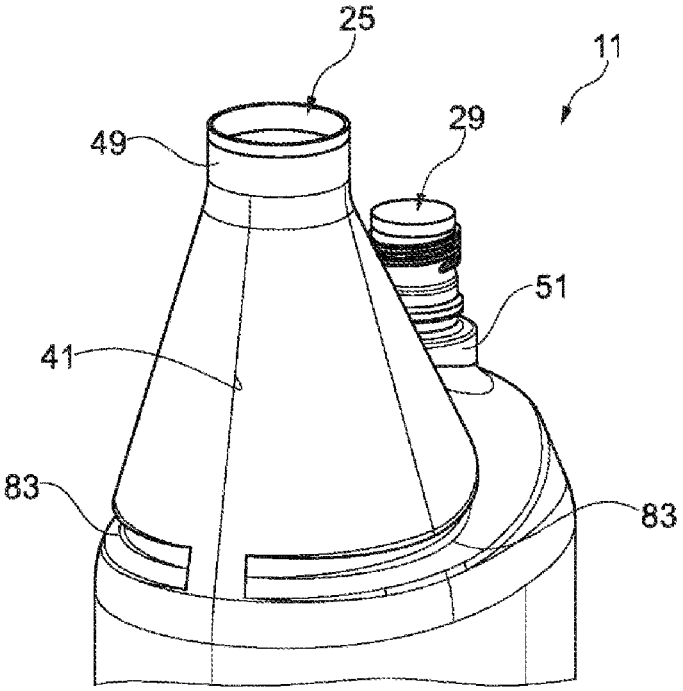
FIG. 15: a perspective view of the container of FIG. 12.

The selection of the magnitude of the angles $\alpha$, $\beta$, $\gamma$ and $\delta$ allows the shoulder geometries to be designed flexibly, as a result of which the following points can be realized:

- By adapting the shoulder geometries, various sizes or volumes of the container 11 can be realized.
- The separation of the height of the pouring opening 29 from the height of the weld seam 79 enables a higher neck design of the second neck 51, whereby sufficient space is present for design elements, such as a captive screw cap 61 or a tamper-evident ring 59. The welding region 80, realized by welding bars, is shown in FIG. 12.
- Sufficient space can be created between the filling opening and the pouring opening 25, 29, in order to facilitate the automatic closing of the pouring opening with a closure tool (capper) and to enable the use of a welding bar for closing the filling opening.
- The design of the shoulder geometries can lead to an optimized lateral inclination of the pouring opening 29 by closing the filling opening 25. This can make use by the consumer more comfortable and can improve the complete emptying of the container 11.

At least one compensating groove 83 can be formed between the first and second shoulders 39, 41, as shown in FIGS. 12 to 15. If the sealing surfaces 27*a*, 27*b* are welded in the welding region 80, severe thermal deformations can arise due to the welding of the filling opening 25. The compensating groove 83 can compensate these deformations, as a result of which the rest of the container is deformed only insignificantly, if at all. The depth of the groove 83 can be variable and can, for example, become smaller and smaller in the direction of the two shoulders 39, 41. As a result, the groove 83 can taper off toward one or both shoulders. The groove can also extend around the shoulders 39, 41 or end in front of one of the shoulders 39, 41 or in front of both shoulders 39, 41. The cross section of the groove 83 can be V-shaped, for example. The compensating groove 83 is formed at the transition of the second shoulder 41 to the container body 13 and at the transition of the second neck 51 or the fourth shoulder 57 into the first shoulder 39.

These designs of the groove 83 make it possible for the compensating groove 83 to compensate differently severe deformations caused by the welding of the filling opening 25 at various locations.

The extrusion blow-molded container 11 is formed in one piece, and the first and second necks 49, 51 are blown together with the container body 13 in one mold. The first and second necks are therefore an integral component of the container 11 and do not have to be subsequently inserted therein and connected thereto. The container 11 is characterized in that during the production in the EBM (extrusion blow molding) method, the filling and pouring openings 25, 29 lie in a line parallel to the extruded tube.

The invention claimed is:

1. A container produced from a plastic material, comprising:

a container body having a first end, a second end substantially opposite the first end, and a jacket;

a filling opening having a first and a second sealing surface formed on an inner wall of the first end, wherein the first and second sealing surfaces are configured to be connected to one another in a fluid-tight manner; and a container base having a standing surface formed at the second end and a pouring opening formed at the first end;

wherein the filling opening has a first center axis and the pouring opening has a second center axis;

wherein the first and second center axes are substantially parallel to one another; and wherein after closing the filling opening, the first and second center axes enclose an acute angle ε with one another.

2. The container according to claim 1, wherein the first and second center axes are oriented parallel to an extrusion direction of the container or to a longitudinal extension of the container.

3. The container according to claim 1, wherein the first and second center axes define a plane that corresponds to a mold parting plane of the container.

4. The container according to claim 1, wherein the filling opening is defined by a first neck surrounding the filling opening and wherein a first and a second shoulder adjoin the first neck.

5. The container according to claim 4, wherein the pouring opening is defined by a second neck surrounding the pouring opening and wherein at least one third shoulder adjoins the second neck.

6. The container according to claim 5, wherein the third shoulder and a fourth shoulder adjoin the second neck.

7. The container according to claim 5, further comprising an external thread formed on the second neck and configured to interact with an internal thread of a screw cap.

8. The container according to claim 5, wherein the second and third shoulders transition into the jacket of the container.

9. The container according to claim 5, wherein the third shoulder transitions into the first shoulder.

10. The container according to claim 5, wherein the second neck rises from a platform formed on the container, wherein the platform has a first and a second flank, the first and second flanks tapering off into the jacket.

11. The container according to claim 5, wherein the first and the second necks are blow-molded together with the container.

12. The container according to claim 4, wherein the first shoulder facing the pouring opening has a convex shape.

13. The container according to claim 1, wherein the pouring opening is positioned below the filling opening.

14. The container according to claim 1, wherein the pouring opening is within the contour of the container base in a plan view of the container.

15. The container according to claim 1, further comprising a ventilation opening on the container.

16. The container according to claim 1, further comprising at least one compensating groove formed on the first and second shoulders, the at least one compensating groove oriented in a circumferential direction of the shoulders and configured to compensate for thermal deformations.

17. The container according to claim 16, wherein the at least one compensating groove tapers off in a direction of the first and second shoulders.

18. The container according to claim 16, wherein a depth of the at least one compensating groove varies along its length.

19. A combination of a container and a screw cap; comprising:

a container comprising:

a container body having a first end, a second end substantially opposite the first end, and a jacket;

a filling opening defined by a first neck surrounding the filling opening and wherein a first and a second shoulder adjoin the first neck, the first neck having a first and a second sealing surface formed on an inner wall of the first end, wherein the first and second sealing surfaces are configured to be connected to one another in a fluid-tight manner; and a container base having a standing surface formed at the second end and a pouring opening defined by a second neck surrounding the pouring opening and wherein at least one third shoulder adjoins the second neck formed at the first end;

wherein the filling opening has a first center axis and the pouring opening has a second center axis; and wherein the first and second center axes are substantially parallel to one another;

wherein after closing the filling opening, the first and second center axes enclose an acute angle & with one another;

a screw cap having an internal thread, the screw cap configured to be attached to the second neck having an external thread, can be unscrewed therefrom and has formed on an inner side thereof a sealing element, which, in the attached state, projects into the pouring opening;

wherein a sealing effect between the sealing element and the second neck is realized in that the second neck is widened when the sealing element projects into the second neck.

20. The combination according to claim 19, wherein the external thread obtains its final stiffness through a screw connection with the screw cap.

21. The combination according to claim 19, wherein the screw cap has a projection to which a tool can be applied and a torque can be transmitted from the tool to the screw cap.

22. The combination according to claim 21, wherein the projection is a depression which acts as the sealing element.

23. A container produced from a plastic material, comprising a container body having a first end, a second end substantially opposite the first end, and a jacket, a filling opening having a first and a second sealing surface formed on an inner wall of the first end, wherein the first and second sealing surfaces are configured to be connected to one another in a fluid-tight manner, a container base having a standing surface formed at the second end and a pouring opening formed at the first end, wherein the filling opening is defined by a first neck surrounding the filling opening and wherein a first and a second shoulder adjoin the first neck, wherein the pouring opening is defined by a second neck surrounding the pouring opening and wherein at least one third shoulder adjoins the second neck;

wherein the filling opening has a first center axis and the pouring opening has a second center axis, and wherein the first and second center axes define a plane, and wherein after closing the filling opening, the first and second center axes enclose an acute angle ε with one another.

24. The container according to claim 23, wherein an imaginary first straight line extending along the first shoulder and lying in the plane encloses an angle α with respect to the first center axis that differs from an angle β that is enclosed, with respect to the first center axis, by an imaginary third straight line extending along the third shoulder and lying in the plane.

25. The container according to claim 24, wherein the angle α is greater than the angle β, or in that the first and third shoulders together form an at least approximately concave shape.

26. The container according to one of claim 24, wherein the angle α is less than the angle β, or in that the first and third shoulders together form an at least approximately convex shape.

27. The container according to one of claim 26 wherein, the third and a fourth shoulder adjoin the second neck, wherein the fourth shoulder transitions into the first shoulder.

28. The container according to claim 27, wherein an imaginary, second straight line extending along the second shoulder and lying in the plane defined by the first and second center axes encloses an angle γ with respect to the first center axis that differs from an angle δ that is enclosed, with respect to the first center axis, by an imaginary, fourth straight line extending along the fourth shoulder and lying in the plane.

29. The container according to claim 28, wherein the angle β and the angle δ are approximately equal and are in the range of 10-30 degrees.

30. The container according to claim 28, wherein the angle β and/or the angle δ is 0 degrees.

31. The container according to claim 28, wherein the angle β and the angle δ are approximately equal and are in the range of 18-22 degrees.

32. The container according to claim 27, wherein at least one of the first, second, third or fourth shoulders is curved and the corresponding first, second, third or fourth straight line is a tangent at an apex of a shoulder curvature of the at least one first, second, third or fourth shoulders.

33. The container according to claim 24, wherein the angle α is in the range of 30-60 degrees.

34. The container according to claim 23, wherein the first center axis and the second center axis are oriented substantially parallel to an imaginary main axis of the container.

35. The container according to claim 23, wherein the pouring opening is provided below the filling opening.

36. The container according to claim 24, wherein the angle α is in the range of 40-50 degrees.

* * * * *